US007927707B2

(12) United States Patent
Kawasaki

(10) Patent No.: US 7,927,707 B2
(45) Date of Patent: Apr. 19, 2011

(54) PLATE MATERIAL AND MANUFACTURING METHOD THEREOF

(75) Inventor: Hiraku Kawasaki, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 752 days.

(21) Appl. No.: 10/554,709

(22) PCT Filed: Oct. 5, 2004

(86) PCT No.: PCT/JP2004/014633

§ 371 (c)(1),
(2), (4) Date: Oct. 27, 2005

(87) PCT Pub. No.: WO2005/035239

PCT Pub. Date: Apr. 21, 2005

(65) Prior Publication Data

US 2006/0210802 A1 Sep. 21, 2006

(30) Foreign Application Priority Data

Oct. 9, 2003 (JP) ..... 2003-350585

(51) Int. Cl.
*B32B 15/20* (2006.01)

(52) U.S. Cl. ..... 428/457; 427/402

(58) Field of Classification Search ..... None
See application file for complete search history.

(56) References Cited

U.S. PATENT DOCUMENTS

| | | | | |
|---|---|---|---|---|
| 4,465,710 | A * | 8/1984 | Uchiyama et al. | 264/46.5 |
| 5,079,087 | A * | 1/1992 | Lever et al. | 428/329 |
| 5,342,871 | A * | 8/1994 | Clinnin et al. | 524/238 |
| 6,013,724 | A * | 1/2000 | Mizutani et al. | 524/588 |
| 6,075,060 | A | 6/2000 | Minnich | |
| 6,482,524 | B1 | 11/2002 | Yamamoto et al. | |
| 6,540,845 | B1 | 4/2003 | Oyama et al. | |
| 2005/0103481 | A1 * | 5/2005 | Kawasaki et al. | 165/133 |

FOREIGN PATENT DOCUMENTS

| | | | |
|---|---|---|---|
| CN | 1235063 | A | 11/1999 |
| JP | 59-205596 | | 11/1984 |
| JP | 60-058269 | | 4/1985 |
| JP | 60-082169 | | 5/1985 |
| JP | 62-105629 | | 5/1987 |
| JP | 62-278033 | | 12/1987 |
| JP | 63-303729 | | 12/1988 |
| JP | 2001-240689 | | 9/1989 |
| JP | 06-065524 | A | 3/1994 |
| JP | 07-047329 | A | 2/1995 |
| JP | H07-041702 | A | 2/1995 |
| JP | H07-151489 | A | 6/1995 |
| JP | 07-216274 | A | 8/1995 |
| JP | 08269367 | * | 10/1996 |
| JP | 11-153899 | A | 6/1999 |
| JP | 2000-328259 | A | 11/2000 |
| JP | 2001-503100 | A | 3/2001 |
| JP | 2001-342575 | A | 12/2001 |
| JP | 2003-113346 | A | 4/2003 |
| JP | 2003-171774 | | 6/2003 |

* cited by examiner

*Primary Examiner* — D. Lawrence Tarazano
*Assistant Examiner* — Gregory Clark
(74) *Attorney, Agent, or Firm* — Global IP Counselors

(57) ABSTRACT

A plate material includes a substrate and a coating. The substrate is a plate-like member that does not have protrusions and depressions of submicron order oriented in the thickness direction thereof. The coating is formed on the surface of the substrate with a paint-like material having affinity with respect to the substrate.

24 Claims, 2 Drawing Sheets

PLATE MATERIAL AND MANUFACTURING METHOD THEREOF

CROSS REFERENCE TO RELATED APPLICATIONS

This U.S. national stage application claims priority under 35 U.S.C. §119(a) to Japanese Patent Application No. 2003-350585, filed in Japan on Oct. 9, 2003, the entire contents of which are hereby incorporated by reference.

TECHNICAL FIELD

The present invention relates to a plate material and a manufacturing method thereof.

BACKGROUND OF THE INVENTION

The outdoor units and indoor units of air conditioning systems are generally provided with heat exchangers for exchanging heat with the outside air. The heat exchangers are normally provided with a plurality of heat radiating fins, a plurality of heat exchanger tubes, and a propeller or other blowing means. The plurality of heat radiating fins are plate-like members arranged with a prescribed spacing there-between along the thickness direction thereof. The plurality of heat exchanger tubes are arranged so as to pass through the plurality of heat radiating fins in the thickness direction of the heat radiating fins. The blowing means serves to deliver a flow of air over the plurality of heat radiating fins and heat exchanger tubes.

In such a heat exchanger, the air blown into the gaps between adjacent heat radiating fins by the blowing means causes heat to be exchanged and the refrigerant flowing inside the heat exchanger tubes either evaporates or condenses.

The heat radiating fins generally comprise a plate material that has been worked into a prescribed fin shape using a die. The plate material is constructed from a plate-like substrate made of pure aluminum or an aluminum alloy and a coating that is formed on the surface of the substrate. Normally, the substrate is made by rolling the aluminum or aluminum alloy into a plate-like form using rolling oil and, thus, oil exists on the surface of the substrate.

Consequently, conventionally, when a coating is to be formed on the surface of the substrate, an oil removal treatment is first applied to the substrate and then a coating method like one of the following (for example) is used to form the coating:

(1) A chromic acid treatment is applied to form a chromate coating and a hydrophilic coating is formed over the chromate coating. (See, for example, Japanese Publication No. 62-105629.)

(2) A hydrophilic paint-like material is applied to form the coating. (See, for example, Japanese Publication No. 63-303729.)

(3) A phosphoric acid treatment, an alkaline treatment, etching, or other surface roughening treatment is applied to the substrate and then a corrosion resistant coating is formed on the substrate. (See, for example, Japanese Publication No. 2003-171774.)

With the method (3), a fine roughness (protrusions and depressions) of submicron order is formed on the surface of the substrate.

With the method (1), the equipment cost is large because it is necessary to use a prescribed treatment layer and the running cost is high because harmful waste liquid is discharged from the process and must be treated. Thus, it seems reasonable to omit the chromic acid treatment and select a method such as method (2) in which a paint-like material is applied directly to the substrate using a paint application method. However, when the paint-like material is applied directly, the adhesion between the substrate and the coating is poor and a sufficiently durable plate material cannot be obtained. Meanwhile, when the method (3) is adopted, specific treatment equipment is required and the cost is high.

Also, all of the methods (1) to (3) require the substrate to be treated in advance to remove oil and when a roughening treatment is applied, the number of processing steps required to manufacture the plate material increases and causes the cost to increase.

In the case of a conventional plate material made by applying a chromic acid treatment to the substrate so as to form a chromate coating on the surface of the substrate, the chromate coating improves the corrosion resistance of the plate material. However, since a chromate coating does not have sufficient hydrophilicity, it has poor water wetting characteristic when used as is on a heat radiating fin. As a result, water droplets stuck on the surface of the fin cause such problems as increased air flow resistance.

In view of these issues, technologies have been proposed in which a chromate coating or water soluble resin coating is applied to the surface of the substrate as a corrosion resistant coating and a hydrophilic coating is applied on top of the corrosion resistant coating in order to ensure sufficient degrees of both corrosion resistance and hydrophilicity. (See, for example, Japanese Publication No. 62-105629.) With the technology described in Japanese Publication No. 62-105629, a plate material having sufficient degrees of both corrosion resistance and hydrophilicity can be obtained. Particularly when a water soluble resin is used for the corrosion resistant coating, the treatment layer required for a chromic acid treatment is not necessary and the techonology is thus advantageous in terms of production costs and environmental concerns.

SUMMARY OF THE INVENTION

However, with the conventional technology described above, since a water soluble resin containing a hydrophilic group is used in order to ensure that the corrosion resistant coating adheres to the substrate, the corrosion resistant coating is eroded (washed away) by adhered water and moisture that penetrates the corrosion resistant coating causes the substrate to corrode. As a result, the durability of the plate material declines.

The object of the present invention is to improve the adhesion between the coating and the substrate and to reduce the cost required to produce the plate material.

Another object of the present invention is to provide a plate material having both corrosion resistant and hydrophilic properties, as well as improved durability.

A plate material in accordance with a first aspect of the present invention is provided with a substrate and a coating. The substrate is a plate-like member that does not have protrusions and depressions of submicron order oriented in the thickness direction thereof. The coating is formed on the surface of the substrate and made of a paint-like material having affinity with respect to the substrate.

In the description of the present invention, "submicron-order protrusions and depressions oriented in the thickness direction of the substrate" are protrusions and depressions in the range of sizes equal to or larger than 0.1 μm and smaller than 1.0 μm and are formed on, for example, a rolled plate-like substrate by means of an alkaline treatment, etching treatment, or other roughening treatment. Also, a "paint-like material having affinity with respect to the substrate" is a paint-like material having good adhesion with respect to the substrate when it is in the form of a coating. More specifically, as will be described later, it is a paint-like material containing a specific alcohol-based solvent.

With this plate material, the substrate does not have submicron order protrusions and depressions on its surface and thus has not been subjected to a roughening treatment. However, the coating has excellent adhesion with respect to such a substrate because it is made of a paint-like material having affinity with respect to the substrate. Since this plate material can be obtained without applying a roughening treatment, the production cost is reduced.

A plate material in accordance with a second aspect of the present invention is a plate material in accordance with the first aspect, wherein the paint-like material is a hydrophobic organic paint-like material.

Due to its coating being made of a hydrophobic organic paint-like material, this plate material has excellent corrosion resistance and is well suited for use as heat radiating fins of a heat exchanger.

A plate material in accordance with a third aspect of the present invention is a plate material in accordance with the first or second aspect, wherein the surface tension of the paint-like material is equal to or larger than 25 and less than or equal to 35 dyn/cm.

Since the surface tension of the paint-like material is comparatively small, the paint-like material has good wetting capacity with respect to the surface of the substrate when it is applied, even though the substrate has not been subjected to a roughening treatment. As a result, the paint-like material has good adhesion with respect to the substrate when it is in the form of a coating.

A plate material in accordance with a fourth aspect of the present invention is a plate material in accordance with any one of the first through third aspects, wherein the paint-like material contains an alcohol-based solvent at a content of 1 to 10 wt %. In this invention, the content of the alcohol-based solvent is expressed as a percentage of the total weight of paint-like material (wt %), i.e., the weight of alcohol-based solvent contained in 100 weight units of paint-like material.

With this plate material, the alcohol-based solvent reduces the surface tension of the paint-like material and thereby improves the adhesion between the coating and the substrate.

A plate material in accordance with a fifth aspect of the present invention is a plate material in accordance with any one of the first through third aspects, wherein the paint-like material contains an alcohol-based solvent at a content of 1 to 5 wt %.

With this plate material, the adhesion between the substrate and the coating is improved in a more effective manner because the alcohol-based solvent content is in the aforementioned range (1 to 5 wt %).

A plate material in accordance with a sixth aspect of the present invention is a plate material in accordance with the fourth or fifth aspect, wherein the alcohol-based solvent is made substantially of an alcohol having four or more carbon atoms.

With this plate material, the adhesion between the substrate and the coating is improved in an effective manner because the alcohol-based solvent is made of an alcohol having four or more carbon atoms.

A plate material in accordance with a seventh aspect of the present invention is a plate material in accordance with any one of the first through sixth aspects, wherein the viscosity of the paint-like material is equal to or larger than 5 pa-s and less than or equal to 20 pa-s.

Since the viscosity of the paint-like material is comparatively small, the paint-like material has good wetting capacity with respect to the surface of the substrate where it is applied—even though the substrate has not been subjected to a roughening treatment. As a result, the paint-like material has good adhesion with respect to the substrate when it is in the form of a coating.

A plate material in accordance with an eighth aspect of the present invention is a plate material in accordance with any one of the first through seventh aspects, wherein the coating is a corrosion resistant coating that is formed with a corrosion resistant paint-like material and made of a hydrophobic organic compound. Additionally, in this plate material, a hydrophilic coating made of a hydrophilic paint-like material is provided on the surface of the corrosion resistant coating.

With this plate material, the adhesion between the substrate and the coating is improved and the cost required to produce the plate material is reduced. Furthermore, since the corrosion resistant coating is made of a hydrophobic organic compound and does not contain a hydrophilic group, erosion of the corrosion resistant coating by adhered water is suppressed in comparison with a corrosion resistant coating made of a water soluble resin and moisture can be prevented from penetrating the corrosion resistant coating and causing the substrate to corrode.

A plate material in accordance with a ninth aspect of the present invention is a plate material in accordance with the eighth aspect, wherein the hydrophilic paint-like material contains a volatile organic solvent.

Although it is normally difficult to form a hydrophilic coating on the surface of a corrosion resistant coating made of a hydrophobic organic compound, research conducted by the inventors has shown that a hydrophilic coating can be formed on the surface of such a corrosion resistant coating by using a hydrophilic paint-like material to which an organic solvent has been added. With this plate material, two coatings having different properties can be formed on top of each other with a simple method.

A plate material in accordance with a tenth aspect of the present invention is a plate material in accordance with the eighth or ninth aspect, wherein the corrosion resistant coating is formed on the surface of a substrate that has not been subjected to a chromic acid treatment.

With this plate material, the corrosion resistant coating is made of a hydrophobic organic compound, which has superior durability to a coating made of a water soluble resin. Consequently, the decline in durability that would otherwise result from the omission of the chromate coating can be suppressed. Also, with this plate material, the production cost can be reduced and there is no discharge of harmful waste liquids because the chromic acid treatment is not necessary.

A plate material in accordance with an eleventh aspect of the present invention is a plate material in accordance with any one of the eighth through tenth aspects, wherein the corrosion resistant coating is formed on the surface of a substrate that has not been subjected to an oil removal treatment.

With this plate material, the pre-treatment steps executed with respect to the substrate during manufacturing can be reduced because the oil removal treatment is omitted.

A plate material in accordance with a twelfth aspect of the present invention is a plate material in accordance with any one of the first through eleventh aspects, wherein the substrate is made of pure aluminum or an aluminum alloy.

Aluminum substrates are often manufactured with a rolling process in which rolling oil is used. With this plate material, by using a paint-like material having affinity with respect to the substrate, a coating can be formed on such an aluminum substrate without applying an oil removal treatment.

A plate material in accordance with a thirteenth aspect of the present invention is a plate material in accordance with any one of the first through twelfth aspects, wherein the plate material is used as a heat radiating fin of a heat exchanger.

With this plate material, the adhesion between the substrate and the coating is good and the plate material has excellent durability. Thus, the plate material is well suited for such an application.

A plate material manufacturing method in accordance with a fourteenth aspect of the present invention is provided with a first step and a second step. In the first step, a plate-like substrate that does not have protrusions and depressions of submicron order oriented in the thickness direction thereof on its surface is prepared. In the second step, a coating is formed on the surface of the substrate with a paint-like material having affinity with respect to the substrate.

Research conducted by the present inventor and others has shown that a coating can be formed on the surface of a substrate without subjecting the substrate to an oil removal treatment or a roughening treatment if the coating is made of a paint-like material having affinity with respect to the substrate and is applied directly. Said research demonstrates that when the plate material is made using such a method, excellent adhesion is obtained between the coating and the substrate. Furthermore, by using said method, a plate material having excellent durability is obtained and the production cost can be reduced because such surface treatments as oil removal treatments and roughening treatments can be omitted.

A plate material manufacturing method in accordance with a fifteenth aspect of the present invention is a manufacturing method in accordance with the fourteenth aspect, wherein the paint-like material is a hydrophobic organic paint-like material.

With this manufacturing method, a plate material having excellent corrosion resistance can be obtained because the coating formed on the surface of the substrate is made of a hydrophobic organic paint-like material.

A plate material manufacturing method in accordance with a sixteenth aspect of the present invention is a manufacturing method in accordance with the fourteenth or fifteenth aspect, wherein the paint-like material has a surface tension of 25 dyn/cm to 35 dyn/cm.

With this manufacturing method, since the surface tension of the paint-like material is comparatively small, the paint-like material has good attraction with respect to the surface of the substrate even if the substrate has not been subjected to a roughening treatment. As a result, a plate material having excellent adhesion between the coating and the substrate can be obtained. Also, with this manufacturing method, the production cost of the plate material can be reduced because the oil removal treatment and roughening treatment can be omitted.

A plate material manufacturing method in accordance with a seventeenth aspect of the present invention is a manufacturing method in accordance with any one of the fourteenth through sixteenth aspects, wherein the paint-like material contains an alcohol-based solvent at a content of 1 to 10 wt %.

Research conducted by the inventor specifically demonstrates that when an alcohol-based solvent is added to the paint-like material at the aforementioned content (weight percentage), the paint-like material has good attraction with respect to the substrate—even though the substrate has not been subjected to a roughening treatment—and thus the adhesion between the coating and the substrate is improved. By using this manufacturing method, a plate material having excellent durability can be obtained.

A plate material manufacturing method in accordance with an eighteenth aspect of the present invention is a manufacturing method in accordance with any one of the fourteenth through sixteenth aspects, wherein the paint-like material contains an alcohol-based solvent at a content of 1 to 5 wt %.

With this manufacturing method, the adhesion between the substrate and the coating can be improved in a more effective manner because the alcohol-based solvent content in the paint-like material is in the aforementioned range (1 to 5 wt %).

A plate material manufacturing method in accordance with a nineteenth aspect of the present invention is a plate material in accordance with the seventeenth or eighteenth aspect, wherein the alcohol-based solvent is made substantially of an alcohol having four or more carbon atoms.

With this manufacturing method, since a paint-like material containing an alcohol-based solvent having the aforementioned feature is used, the paint-like material has good attraction with respect to the surface of the substrate even though the substrate has not been subjected to a roughening treatment. As a result, a plate material having excellent adhesion between the coating and the substrate can be obtained.

A plate material manufacturing method in accordance with a twentieth aspect of the present invention is a plate material in accordance with any one of the fourteenth through nineteenth aspects, wherein the viscosity of the paint-like material is equal to or larger than 5 pa-s and less than or equal to 20 pa-s.

With this manufacturing method, since the viscosity of the paint-like material is comparatively small, the paint-like material has good attraction with respect to the surface of the substrate even though the substrate has not been subjected to a roughening treatment. As a result, a plate material having excellent adhesion between the coating and the substrate can be obtained.

A plate material manufacturing method in accordance with a twenty-first aspect of the present invention is a manufacturing method in accordance with any one of the fourteenth through twentieth aspects, wherein in the second step, a corrosion resistant coating made of a hydrophobic organic compound is formed on the surface of the plate-like substrate by applying a corrosion resistant paint-like material. Additionally, this manufacturing method includes a third step in which a hydrophilic coating is formed on the surface of the corrosion resistant coating by applying a hydrophilic paint-like material.

With this manufacturing method, the adhesion between the substrate and the coating is improved and the cost required to produce the plate material is reduced. Furthermore, since the corrosion resistant coating is made of a hydrophobic organic compound, erosion of the corrosion resistant coating by adhered water is suppressed and moisture can be prevented from penetrating the corrosion resistant coating and causing the substrate to corrode.

A plate material manufacturing method in accordance with a twenty-second aspect of the present invention is a manufacturing method in accordance with the twenty-first aspect, wherein in the third step, the hydrophilic paint-like material containing a volatile organic solvent is applied.

With this manufacturing method, the organic solvent contained in the hydrophilic paint-like material enables a hydrophilic coating to be formed easily on the surface of a hydrophobic corrosion resistant coating. Thus, two coatings having different properties can be formed on top of each other with a simple method.

A plate material manufacturing method in accordance with a twenty-third aspect of the present invention is a manufacturing method in accordance with the twenty-first or twenty-second aspect, wherein in the second step, the corrosion resistant painte-like material is applied on the substrate that has not been subjected to a chromic acid treatment.

With this manufacturing method, since the corrosion resistant coating is made of a hydrophobic organic compound, the corrosion resistant coating can be formed satisfactorily on the surface of the substrate even though a chromate coating is not formed. Furthermore, since the corrosion resistant coating is made of a hydrophobic organic compound, the decline in durability that would otherwise result from the omission of the chromate coating is suppressed. Also, with this manufacturing method, the production cost can be reduced and there is no discharge of harmful waste liquids because the chromic acid treatment is not necessary.

A plate material manufacturing method in accordance with a twenty-fourth aspect of the present invention is a manufacturing method in accordance with the twenty-first or twenty-third aspect, wherein in the second step, the corrosion resistant paint-like material is applied on the substrate that has not been subjected to an oil removal treatment.

With this manufacturing method, the pre-treatment steps executed with respect to the substrate during manufacturing can be reduced because the oil removal treatment is omitted.

A plate material manufacturing method in accordance with a twenty-fifth aspect of the present invention is a manufacturing method in accordance with any one of the fourteenth through twenty-fourth aspects, wherein the substrate is made of pure aluminum or an aluminum alloy.

With this manufacturing method, the adhesion of the coating can be improved even with respect to the substrate that is often rolled using a rolling oil.

A plate material manufacturing method in accordance with a twenty-sixth aspect of the present invention is a manufacturing method in accordance with any one of the fourteenth through twenty-fifth aspects, wherein the plate material is used as a heat radiating fin of a heat exchanger.

With manufacturing method, the adhesion between the substrate and the coating is good and a plate material having excellent durability is obtained. Thus, the plate material is well suited for such an application.

With the first aspect, excellent adhesion is achieved between the coating and the substrate even when the substrate has not been roughened because the coating is made with paint-like material having affinity with respect to the substrate. Since this plate material can be obtained without applying a roughening treatment, the production cost is reduced.

With the second aspect, the corrosion resistance is excellent and thus the plate material is well suited for use as, for example, a heat radiating fin of a heat exchanger.

With the third aspect, the paint-like material has good attraction with respect to the surface of the substrate even if the substrate has not been subjected to a roughening treatment and, thus, the paint-like material has good adhesion with respect to the substrate when it is in the form of a coating.

With the fourth aspect, the adhesion between the coating and the substrate is improved.

With the fifth aspect, the adhesion between the coating and the substrate is improved even more effectively.

With the sixth aspect, the adhesion between the coating and the substrate is improved even more effectively.

With the seventh aspect, the paint-like material has good attraction with respect to the surface of the substrate even if the substrate has not been subjected to a roughening treatment and, thus, the paint-like material has good adhesion with respect to the substrate when it is in the form of a coating.

With the eighth aspect, the adhesion between the substrate and the coating is improved and the cost required to produce the plate material is reduced. Furthermore, since the corrosion resistant coating is made of a hydrophobic organic compound and does not contain a hydrophilic group, erosion of the corrosion resistant coating by adhered water is suppressed in comparison with a corrosion resistant coating made of a water soluble resin and moisture can be prevented from penetrating the corrosion resistant coating and causing the substrate to corrode.

With the ninth aspect, two coatings having different properties can be formed on top of each other with a simple method.

With the tenth aspect, the decline in durability that would otherwise result from the omission of the chromate coating can be suppressed. Also, the production cost can be reduced and there is no discharge of harmful waste liquids because the chromic acid treatment is not necessary.

With the eleventh aspect, the corrosion resistant coating is made of a hydrophobic organic compound, which has superior durability to a coating made of a water soluble resin. Consequently, the decline in durability that would otherwise result from the omission of the chromate coating can be suppressed. Also, with this plate material, the production cost can be reduced and there is no discharge of harmful waste liquids because the chromic acid treatment is not necessary.

Aluminium substrates are often manufactured with a rolling process in which rolling oil is used. With the twelfth aspect, by using a paint-like material having affinity with respect to the substrate, a coating can be formed on such an aluminium substrate without applying an oil removal treatment.

With the thirteenth aspect, the adhesion between the substrate and the coating is good and the plate material has excellent durability. Thus, the plate material is well suited for use as a heat radiating fin for a heat exchanger.

With the fourteenth aspect, a plate material having excellent durability is obtained and the production cost can be reduced because such surface treatments as oil removal treatments and roughening treatments can be omitted.

With the fifteenth aspect, a plate material having excellent corrosion resistance can be obtained because the coating formed on the surface of the substrate is made of a hydrophobic organic paint-like material.

With the sixteenth aspect, the paint-like material has good attraction with respect to the surface of the substrate even if the substrate has not been subjected to a roughening treatment and, thus, a plate material having excellent adhesion between the coating and the substrate can be obtained. Also, the production cost of the plate material can be reduced because the oil removal treatment and roughening treatment can be omitted.

With the seventeenth aspect, a plate material having excellent durability can be obtained.

With the eighteenth aspect, the adhesion between the coating and the substrate of the plate material is improved even more effectively.

With the nineteenth aspect, the paint-like material has good attraction with respect to the surface of the substrate even if the substrate has not been subjected to a roughening treatment and, as a result, a plate material having excellent adhesion between the coating and the substrate can be obtained.

With the twentieth aspect, the paint-like material has good attraction with respect to the surface of the substrate even if the substrate has not been subjected to a roughening treatment and, thus, a plate material having excellent adhesion between the coating and the substrate can be obtained.

With the twenty-first aspect, the adhesion between the substrate and the coating is improved and the cost required to produce the plate material is reduced. Furthermore, since the corrosion resistant coating is made of a hydrophobic organic compound, erosion of the corrosion resistant coating by adhered water is suppressed and moisture can be prevented from penetrating the corrosion resistant coating and causing the substrate to corrode.

With the twenty-second aspect, two coatings having different properties can be formed on top of each other with a simple method.

With the twenty-third aspect, since the corrosion resistant coating is made of a hydrophobic organic compound, the corrosion resistant coating can be formed satisfactorily on the surface of the substrate even though a chromate coating is not formed. Furthermore, since the corrosion resistant coating is made of a hydrophobic organic compound, the decline in durability that would otherwise result from the omission of the chromate coating is suppressed. Also, with this manufacturing method, the production cost can be reduced and there is no discharge of harmful waste liquids because the chromic acid treatment is not necessary.

With the twenty-fourth aspect, the pre-treatment steps executed with respect to the substrate during manufacturing can be reduced because the oil removal treatment is omitted.

With the twenty-fifth aspect, the adhesion of the coating can be improved even with respect to the substrate that is often rolled using a rolling oil.

With the twenty-sixth aspect, the adhesion between the substrate and the coating is good and a plate material having excellent durability is obtained. Thus, the plate material is well suited for the aforementioned application.

DESCRIPTION OF THE INVENTION

Figure 1:
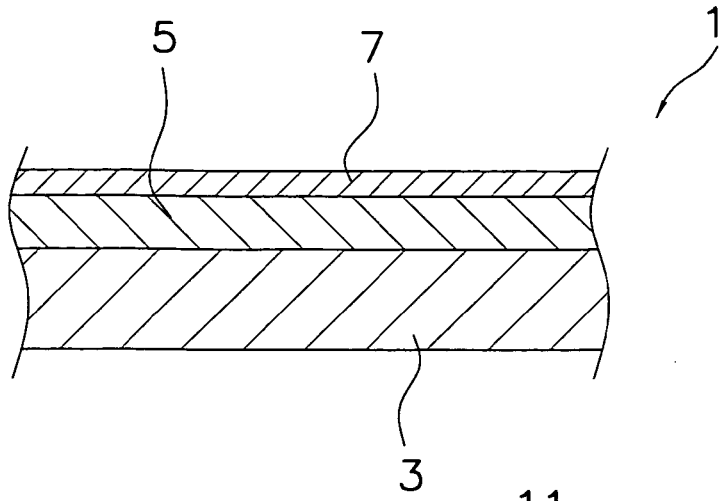
FIG. 1 is a vertical cross sectional view of a plate material that employs an embodiment of the present invention.

FIG. 1 shows a plate material that employs an embodiment of the present invention.

Figure 2:
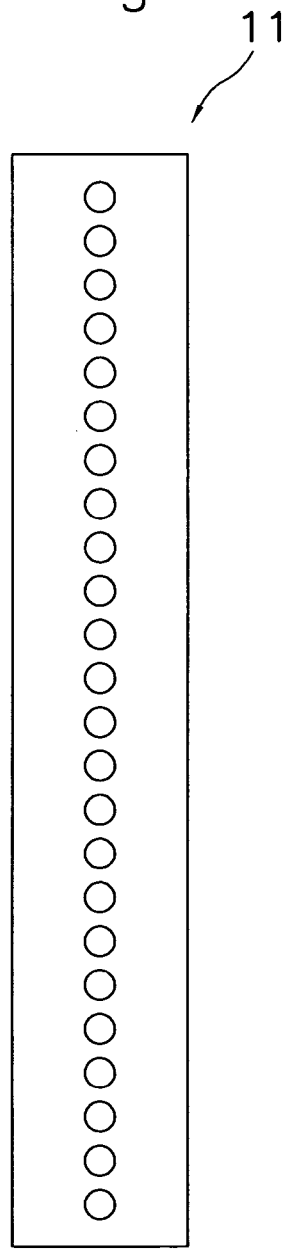
FIG. 2 is a top plan view of a heat exchanger heat radiating fin made of the plate material.
Figure 3:
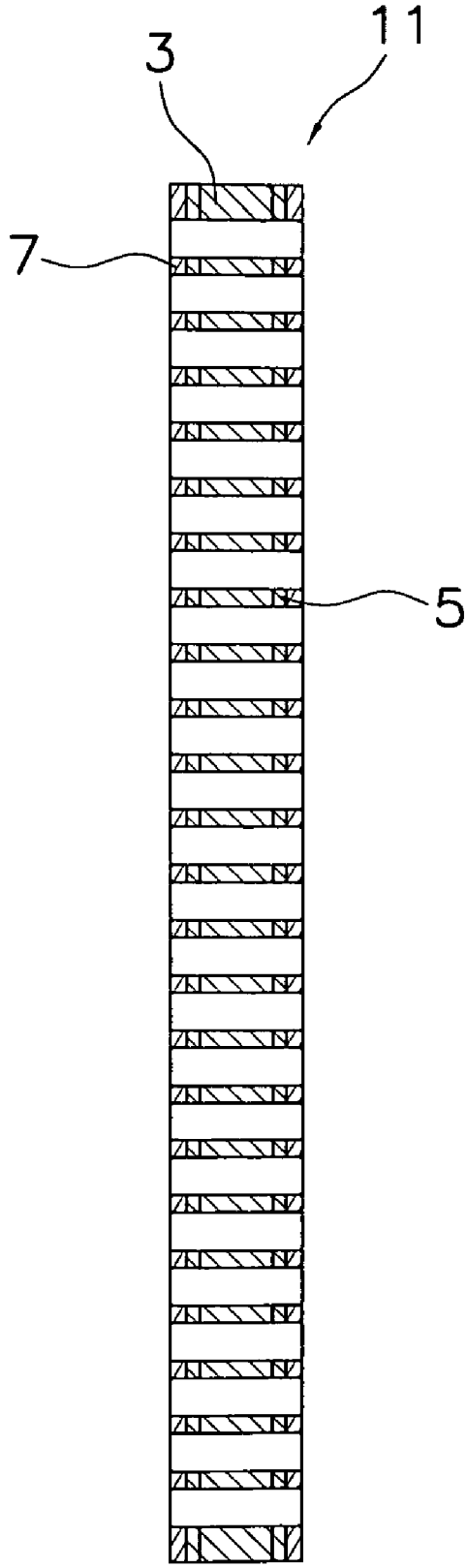
FIG. 3 is a vertical cross sectional view of the same heat radiating fin.

Although the plate material 1 described herein is preferred for use as a heat radiating fin for a heat exchanger, the plate material 1 of the present invention can be used for applications other than a heat radiating fin 11 for a heat exchanger (see FIGS. 2 and 3). The invention is not limited in any particular way to the constituent features described below.

The plate material 1 includes a substrate 3, a corrosion resistant coating 5, and a hydrophilic coating 7.

The substrate 3 is a plate-like member made of pure aluminium or an aluminium alloy. Examples of aluminium allows that can be used include Al—Cu alloys, Al—Mg alloys, and Al—Mg—Si alloys. The substrate 3 made by rolling the aluminium or aluminium alloy using a rolling oil and rolling oil remains on the surface thereof.

The substrate 3 in this embodiment is worked into a plate-like form by rolling the aluminium or aluminium alloy using a rolling oil. The substrate 3 does not have protrusions and depressions of submicron order oriented in the thickness direction thereof, i.e., does not have fine scratches formed by a surface roughening treatment or other surface treatment. Furthermore, the substrate 3 may have protrusions and depressions of larger than submicron order formed by contact with the rollers during rolling.

The thickness of the substrate 3 is preferably in the range of 80 to 150 μm or, even more preferably, in the range of 90 to 120 μm. A thickness of 115 μm is particularly preferred.

The corrosion resistant coating 5 is formed on the surface of the substrate 3 with a paint-like material (which can include a corrosive resistant paint-like material) that has affinity with respect to the substrate 3 and is made of a hydrophobic organic compound. As will be described later, the corrosion resistant coating 5 is formed in a corrosion resistant coating forming step in which a paint-like material (which can include a corrosive resistant paint-like material) that has affinity with respect to the substrate 3 and is applied to the surface of the substrate 3 and dried. Here, a coating made of a hydrophobic organic compound means that the coating does not contain any hydrophilic groups. More specifically, when the coating is analysed with an infrared spectrometer, peaks resulting from such hydrophilic groups as hydroxy groups and carboxyl groups are substantially not detected in the infrared spectrum.

The paint-like material having affinity with respect to the substrate is a hydrophobic organic paint-like material and contains a coating film forming component, additives, a solvent, and a pigment. The coating film forming component is preferably a dual component resin, such as acrylic-melamine resin, urethane-phenol resin, or zirconium fluoride-acrylic resin, because such dual component resins have superior corrosion resistance compared to the epoxy resins conventionally used for corrosion resistant coatings. Examples of additives include plasticizers, hardeners, pigment dispersing agents, and emulsifying agents.

For reasons related to the paint-like material drying characteristics and the resin solubility, it is preferable for the solvent to be an alcohol-based solvent made substantially of an alcohol having four or more carbon atoms, such as butanol and hexanol. For reasons related to the resin solubility, it is preferable for the solvent content in the paint-like material to be at least 1 wt % (i.e., 1 weight unit of solvent per 100 weight units of paint-like material) and still more preferable for the solvent content to be at least 3 wt %. Meanwhile, for reasons related to flammability, it is preferable for the solvent content not to exceed 10 wt % and still more preferable for the solvent content not to exceed 5 wt %. For reasons related to liquid repellency, it is preferable for the surface tension of the hydrophobic organic paint-like material to be at least 5 dyn/cm and still more preferable for the surface tension to be at least 25 dyn/cm. Meanwhile, for reasons related to penetration into the protrusions and depressions of the surface, it is preferable for the surface tension not to exceed 50 dyn/cm and still more preferable for the surface tension not to exceed 35 dyn/cm.

The thickness of the corrosion resistant coating 5 is preferably in the range of 0.5 to 3.0 μm and still more preferably in the range of 1 to 1.5 μm. A thickness of 1.0 μm is particularly preferred.

The hydrophilic coating 7 is a coating formed on the surface of the corrosion resistant coating 5 and is made of a hydrophilic paint-like material. As will be described later, the hydrophilic coating 7 is made in a hydrophilic coating forming step in which a corrosive resistant paint-like material is applied to the surface of the corrosion resistant coating 5 and dried. The hydrophilic paint-like material contains a coating film forming component, additives, a solvent, and a pigment. Specifically, the coating film forming component is preferably a polyethylene glycol resin, a polyvinyl alcohol acrylic resin, or a cellulose acrylic resin.

The thickness of the corrosion resistant coating 7 is preferably in the range of 0.1 to 1.0 μm and still more preferably in the range of 0.3 to 0.5 μm. A thickness of 0.3 μm is particularly preferred.

The method of manufacturing the plate material will now be described.

The manufacturing method includes a substrate preparation step, a corrosion resistant coating forming step, and a hydrophilic coating forming step.

In the substrate preparation step, a plate-like substrate that does not have protrusions and depressions of submicron order or larger oriented in the thickness direction thereof on its surface is prepared. The substrate 3 prepared in this step has been made by rolling a substrate material into a plate-like form using rolling oil and rolling oil remains on the surface thereof.

In the corrosion resistant coating forming step, the such surface treatments as a surface roughening treatment are not performed and the corrosion resistant coating 5 is formed by applying the above-described paint-like material having affinity with respect to the substrate 3 and drying the applied paint-like material. The method of applying the corrosion resistant paint-like material is preferably to roll it on using a roll coater, but it is also acceptable to use such paint application methods as spraying painting, dipping, and wash-coating. One method of drying the corrosion resistant paint-like material when the paint-like material is applied with a roller is to transport the substrate 3 through a drying furnace located downstream of the roller, but the invention is not limited to this method. Specifically, the drying is preferably conducted in an atmosphere having a temperature of at least 180° C. and not more than 300° C. for 10 minutes or less. During the drying process, the hydrophilic groups contained in the emulsifying agent and other components of the corrosion resistant paint-like material change into other functional groups and disappear.

In the hydrophilic coating forming step, the hydrophilic coating 7 is formed by applying the above-described hydrophilic paint-like material to the surface of the corrosion resistant coating 5 and drying the applied paint-like material. The methods of applying and drying the hydrophilic paint-like material can be the same as those described regarding the corrosion resistant coating forming step, but it is also acceptable for different methods to be used. In the case of the hydrophilic paint-like material, the drying is preferably conducted in an atmosphere having a temperature of at least 150° C. and not more than 250° C. for 10 minutes or less.

With this manufacturing method, since the paint-like material used to form the corrosion resistant coating 5 contains a prescribed content (weight percentage) of an alcohol-based solvent and thus the surface tension thereof is small, the paint-like material has good attraction with respect to the substrate 3 even though the substrate has not been subjected to a roughening treatment. As a result, the paint-like material has excellent adhesion with respect to the substrate 3 when it is in the form of a coating. Thus, a plate material 1 having excellent durability can be obtained with a simple method.

Additionally, the production cost of the plate material 1 can be reduced because such surface treatments as oil removal treatments and roughening treatments can be omitted, thereby reducing the number of manufacturing steps and eliminating the need for the processing equipment that would otherwise be required for said surface treatments. In particular, since the substrate 3 does not need to be subjected to a chromic acid treatment, the production cost can be reduced because there is no need to prepare a treatment layer for the chromic acid treatment and the process is environmentally friendly because there is no discharge of waste liquid containing heavy metals.

Additionally, although the corrosion resistant coating 5 is formed directly on the surface of the substrate 3 without a chromate coating disposed there-between, the plate material 1 obtained with this method has excellent corrosion resistance because the corrosion resistant coating 5 is made of a hydrophobic organic compound and the decline in corrosion resistance that would otherwise result from the omission of the chromate coating is suppressed.

Also, with this manufacturing method, since both a corrosion resistant coating 5 and a hydrophilic coating 7 are formed, the properties of both corrosion resistance and hydrophilicity are obtained. Since the corrosion resistant coating 5 is made of a hydrophobic organic compound, erosion of the corrosion resistant coating by adhered water is almost eliminated in comparison with a corrosion resistant coating made of a water soluble resin and, thus, moisture is prevented from penetrating the corrosion resistant coating 5 and causing corrosion to start and progress between the substrate 3 and the corrosion resistant coating 5. In short, a plate material 1 having excellent durability can be obtained with this method.

Since the plate material 1 has a high corrosion resistance and its surface is highly hydrophilic, it is well suited for use as a heat exchanger heat radiating fin 11 like that shown in FIGS. 2 and 3, particularly a heat radiating fin 11 for a heat exchange used in an outdoor unit. The heat radiating fin 11 is made, for example, by punching the plate material 1 with a prescribed die.

(a) It is acceptable for the hydrophilic paint-like material used to form the hydrophilic coating to contain an organic solvent in addition to the components mentioned in the previously described embodiment. There are no particular limitations on organic solvent so long as it is volatile, but ammonia and alcohol-based solvents are preferred. From the viewpoint of flammability and legal constraints, the content of the organic solvent in the hydrophilic paint-like material is preferably in the range of 5 to 20 wt % (i.e., 5 to 20 weight units of organic solvent per 100 weight units of hydrophilic paint-like material).

Also, there does not necessarily have to be a well defined boundary surface between the corrosion resistant coating and the hydrophilic coating. It is acceptable for the organic solvent of the hydrophilic paint-like material to chemically affect the surface of the corrosion resistant coating (for example, forming roughness on the surface) such that the two coatings are closely adhered to each other and a portion of the constituent components of the corrosion resistant coating are dispersed in the hydrophilic coating when coatings are formed.

Research conducted by the inventor demonstrates that a plate material provided with such a hydrophilic coating has a small contact angle (i.e., less than 30°) in the initial state. Here, "initial state" refers to the state of the plate material in the period from when the hydrophilic coating 7 is formed until when the plate material is first used.

Since the hydrophilic paint-like material contains an organic solvent, it affects the surface of the corrosion resistant coating when it is applied to the surface of the corrosion resistant coating. As a result, the corrosion resistant coating and the hydrophilic coating of the plate material have increased adhesion at the boundary surface there-between. Thus, with this method, the hydrophilic coating can be formed satisfactorily on the surface of the corrosion resistant coating using a simple method that does not involve such special surface treatments as a corona discharge treatment.

(b) It is also acceptable to manufacture a plate material like that described in (a) above, wherein a corona discharge or other plasma treatment or an ultraviolet irradiation treatment is applied to the surface of the corrosion resistant coating instead of adding an organic solvent to the hydrophilic paint-like material. A hydrophilic paint-like material that does not contain an organic solvent (although it is acceptable if it does contain an organic solvent) is then applied to the corrosion resistant coating.

(c) It is acceptable if an oil removal treatment is applied to the surface of the substrate in the substrate preparation step.

(d) It is not necessary for the substrate to be made of pure aluminium or an aluminium alloy.

With the present invention, excellent adhesion is achieved between the coating and the substrate even when the substrate has not been roughened because the coating is made with paint-like material having affinity with respect to the substrate. Since this plate material can be obtained without applying a roughening treatment, the production cost is reduced.

With the present invention, the adhesion between the substrate and the coating is improved and the cost required to produce the plate material is reduced. Furthermore, since the corrosion resistant coating is made of a hydrophobic organic compound and does not contain a hydrophilic group, erosion of the corrosion resistant coating by adhered water is suppressed in comparison with a corrosion resistant coating made of a water soluble resin and moisture can be prevented from penetrating the corrosion resistant coating and causing the substrate to corrode.

The invention claimed is:

1. A plate material, comprising:

a plate substrate being free of protrusions and depressions of submicron order oriented in a thickness direction thereof with a rolling oil being used and remaining on the plate substrate;

a substrate coating formed on a surface of the plate substrate with a corrosion resistant hydrophobic organic paint material, the corrosion resistant hydrophobic organic paint material including a coating film component, the coating film component being a two-component resin, and an alcohol-based solvent, a content of the alcohol-based solvent being 1 to 10 wt % when the corrosion resistant hydrophobic organic paint material is applied; and a hydrophilic coating made of a hydrophilic paint material being provided on a surface of the substrate coating, the corrosion resistant hydrophobic organic paint material having affinity with both the plate substrate with the rolling oil remaining on the surface and the hydrophilic coating.

2. The plate material recited in claim 1, wherein the paint material includes a hydrophobic organic paint material.

3. The plate material recited in claim 1, wherein a surface tension of the paint material is equal to or greater than 25 and less than or equal to 35 dyn/cm.

4. The plate material recited in claim 1, wherein the paint material contains an alcohol-based solvent at a content of 1 to 5 wt %.

5. The plate material recited in claim 1, wherein the alcohol-based solvent is made substantially of an alcohol having four or more carbon atoms.

6. The plate material recited in claim 1, wherein the viscosity of the paint material is equal to or greater than 5 Pa-s and less than or equal to 20 Pa-s.

7. The plate material recited in claim 1, wherein the hydrophilic paint material contains a volatile organic solvent.

8. A plate material recited in claim 1, wherein the surface of the substrate having the substrate coating has not been subjected to a chromic acid treatment.

9. The plate material recited in claim 1, wherein the surface of the substrate having the substrate coating has not been subjected to an oil removal treatment.

10. The plate material recited in claim 1, wherein the substrate is made of pure aluminum or an aluminum alloy.

11. A heat radiating fin of a heat exchanger including a plate material as recited in claim 1.

12. A plate material manufacturing method, comprising:

preparing a plate substrate being free of protrusions and depressions of submicron order oriented in a thickness direction thereof and having a rolling oil on a surface of the plate substrate;

applying a corrosion resistant hydrophobic organic paint material on the rolling oil which is on the surface of the plate substrate for forming a substrate coating, the corrosion resistant hydrophobic organic paint material including a coating film component, the coating film component being a two-component resin, and an alcohol-based solvent, a content of the alcohol-based solvent being 1 to 10 wt % when the corrosion resistant hydrophobic organic paint material is applied; and providing a hydrophilic coating on a surface of the substrate coating by applying a hydrophilic paint material, the corrosion resistant hydrophobic organic paint material having affinity with both the plate substrate with the rolling oil remaining on the surface and the hydrophilic coating.

13. The plate material manufacturing method recited in claim 12, wherein the paint material is a hydrophobic organic paint material.

14. The plate material manufacturing method recited in claim 12, wherein the paint material has a surface tension of 25 dyn/cm to 35 dyn/cm.

15. The plate material manufacturing method recited in claim 12, wherein the paint material contains an alcohol-based solvent at a content of 1 to 5 wt %.

16. The plate material manufacturing method recited in claim 12, wherein the alcohol-based solvent is made substantially of an alcohol having four or more carbon atoms.

17. The plate material manufacturing method recited in claim 12, wherein the viscosity of the paint material is equal to or greater than 5 Pa-s and less than or equal to 20 Pa-s. Zone Name: OCRZone

18. The plate material manufacturing method recited in claim 12, wherein the hydrophilic paint material contains a volatile organic solvent.

19. The plate material manufacturing method recited in claim 12, wherein the corrosion resistant paint material is applied on the substrate that has not been subjected to a chromic acid treatment.

20. The plate material manufacturing method recited in claim 12, wherein the corrosion resistant paint material is applied on the substrate that has not been subjected to an oil removal treatment.

21. The plate material manufacturing method recited in claim 12, wherein the substrate is made of pure aluminum or an aluminum alloy.

22. The plate material manufacturing method recited in claim 12, further comprising forming the plate material into a heat radiating fin of a heat exchanger.

23. The plate material recited in claim 1, wherein the substrate coating is formed after drying the corrosion resistant hydrophobic organic paint material that contains the alcohol-based solvent.

24. The plate material manufacturing method recited in claim 12, further comprising drying the corrosion resistant hydrophobic organic paint material for forming the substrate coating.

* * * * *